US006431938B1

(12) United States Patent
Carlton et al.

(10) Patent No.: US 6,431,938 B1
(45) Date of Patent: Aug. 13, 2002

(54) INFLATABLE BALLOON ASSEMBLY

(75) Inventors: William Charles Carlton; Sarah Jane Gauci Carlton, both of Marsaxlokk (GB)

(73) Assignee: Carlton & Carlton Ltd., Marsaxlokk (MT)

( * ) Notice: Subject to any disclaimer, the term of this patent is extended or adjusted under 35 U.S.C. 154(b) by 0 days.

(21) Appl. No.: 09/831,077

(22) PCT Filed: Nov. 30, 1999

(86) PCT No.: PCT/EP99/09305

§ 371 (c)(1),
(2), (4) Date: May 3, 2001

(87) PCT Pub. No.: WO00/32280

PCT Pub. Date: Jun. 8, 2000

(30) Foreign Application Priority Data

Nov. 30, 1998 (GB) ..... 9826144

(51) Int. Cl.[7] ..... A63B 65/00

(52) U.S. Cl. ..... 446/220; 53/403; 53/417; 473/579; 473/580

(58) Field of Search ..... 446/220, 222, 446/221, 224; 53/403, 417; 473/579, 580, 570, 578, 594, 603

(56) References Cited

U.S. PATENT DOCUMENTS

| | | | | |
|---|---|---|---|---|
| 1,393,407 A | * | 10/1921 | Tenney | 473/580 |
| 4,516,949 A | | 5/1985 | Schwartz | |
| 4,657,262 A | * | 4/1987 | Buckland | 473/580 |
| 5,482,492 A | | 1/1996 | Becker | |
| 5,732,530 A | | 3/1998 | Pfaff | |
| 6,227,991 B1 | * | 5/2001 | Carlton et al. | 473/579 |

FOREIGN PATENT DOCUMENTS

| | | | |
|---|---|---|---|
| EP | 0 111 463 A | | 6/1984 |
| FR | 950 525 A | | 9/1949 |
| GB | 2 312 855 A | | 11/1997 |
| GB | 2343125 | * | 10/1998 |
| WO | WO 97 43018 | | 11/1997 |

* cited by examiner

*Primary Examiner*—Jacob K. Ackun
(74) *Attorney, Agent, or Firm*—Clifford W. Browning; Woodard, Emhardt, Naughton, Moriarty & McNett

(57) ABSTRACT

An inflatable balloon assembly comprises a balloon having a balloon inlet (1) and an inflatable portion (8), an inflating tube (3, 4) and a compressing device which has a small hole (5) through which the balloon inlet (1) is forcibly drawn thus forming a compressed area (11) in the balloon inlet (1). The inflating tube (3, 4) incorporates a larger external diameter part (3) which remains outside the compressed area (11) and which is adapted to be connected to a pump and, adjoining the larger external diameter part (3), a substantially smaller external diameter part (4) the free end of which is forcibly drawn through the inside of the balloon inlet (1) within the compressed area (11) into the inflatable portion (8) of the balloon.

6 Claims, 1 Drawing Sheet

FIG.1
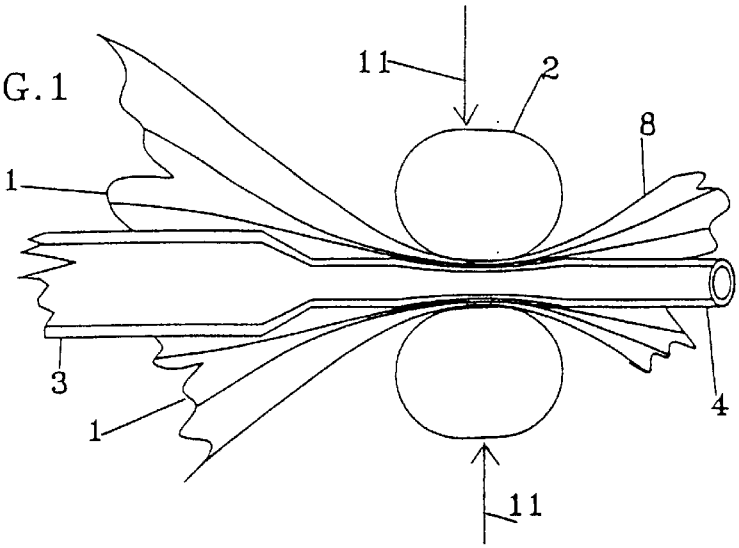
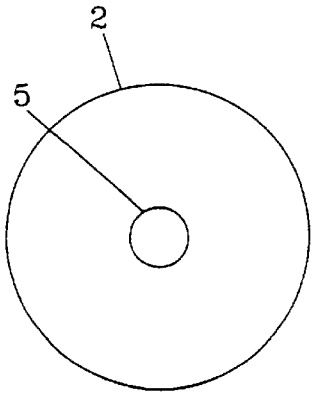
FIG.2
FIG.3
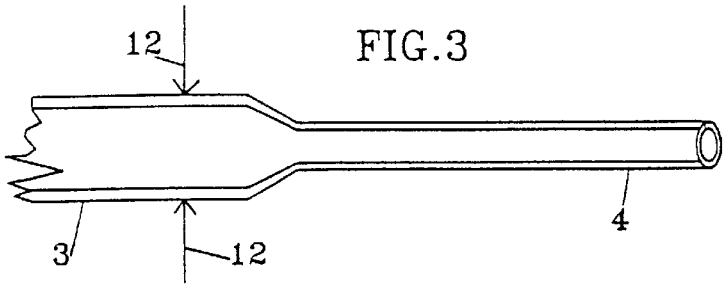
FIG.4
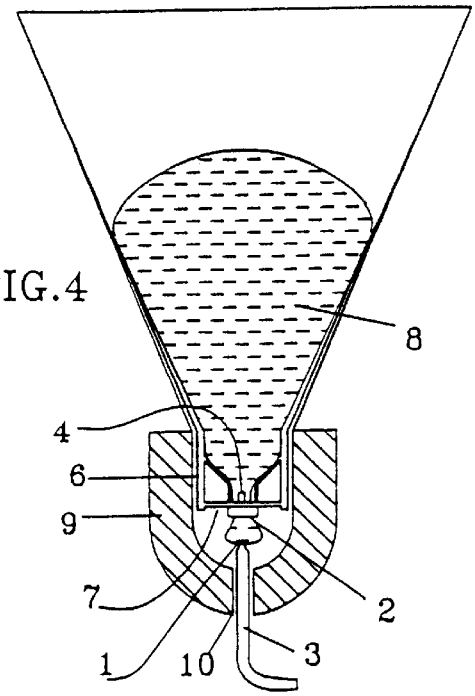
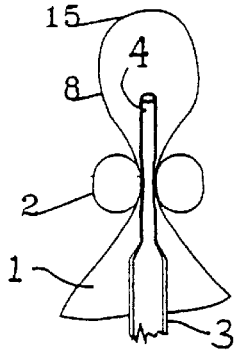
FIG.5
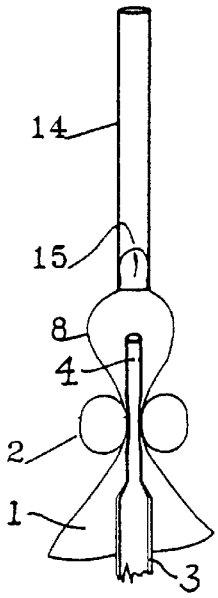
FIG.6

INFLATABLE BALLOON ASSEMBLY

TECHNICAL FIELD

This invention relates to very small inflatable balloon assemblies for use in combination with shuttlecocks used in the game of badminton.

1. Background Art

The nearest prior art is the inflatable balloon assembly proposed in GB 2 312 855A and WO 97/43018 from which a balloon assembly as specified in the entering clause of claim 1 has been known. The balloon is inflated through a small bore tube which, when removed after inflation, leaves the gas (air) sealed in the balloon. This system is satisfactory when the small bore tube is a very fine tubular needle or when an even finer needle is used to inject the gas into a very small bore plastic tube or, if the latex membrane of a balloon is thick enough to enable a small bore tube of constant diameter to be used. Further, from EP-A-0 111 463 a plastics material ball structure with inflating valve has been known wherein an inflating needle having a smaller external diameter portion may be pressure inserted, with that portion through a capillary hole in an elastic seat. At its end remote from that seat, the inflating needle has a larger diameter threaded portion which is adapted to be connected to a source of pressurized air.

2. Technical Problems to be Solved

A major technical problem is caused by the very small dimensions of the small bore tube necessary to seal the balloon satisfactorily, combined with the necessity that inflation must be done by the user of a shuttlecock and not by the manufacturer.

There are medical objections to the use of a fine tubular steel needle when several people might be handling it as in a club; further, a steel needle causes packing problems. If a plastic tube is used which is small enough to prevent leakage when withdrawn it cannot be inflated direct from a pump. A larger diameter tube can be used if the latex membrane of the balloon is increased in thickness but this is detrimental to the performance of shuttlecocks. A further problem is that badminton clubs leave intervals between playing sessions, so that a replacement balloon becomes necessary for the next session.

DISCLOSURE OF THE INVENTION

The present invention seeks to overcome the above problems in an inflatable balloon assembly for use in combination with a shuttlecock which has an inner skirt, the assembly comprising:

a balloon which incorporates a balloon inlet and an inflatable portion, the inflatable portion having a closed end opposite said balloon inlet, an inflating device which incorporates a flexible inflating tube, preferably a plastic tube, and a compressing device such as a small elastic ring, for instance a suitable 'O'-ring, which has a small hole through which the said balloon inlet extends thus forming a compressed area in said balloon inlet.

According to the present invention, the technical problems mentioned above are solved in that said flexible inflating tube incorporates two parts having substantially different external diameters namely, a larger external diameter part which remains outside the said compressed area and which is adapted to be connected to a pump or the like and, adjoining, and preferably integral with, the said larger external diameter part, a substantially smaller external diameter part the free end of which extends through the inside of said balloon inlet within said compressed area thereof into the inflatable portion of said balloon, and the inflatable balloon assembly further comprises a large bore tube, a part of said closed end of said balloon extending into one end of the said large bore tube, the arrangement being such that the inflatable portion of the balloon may be drawn, by means of said large bore tube,into a space within said shuttlecock which is surrounded by the said inner skirt thereof, the inflatable portion being adapted to be subsequently inflated within said space.

ADVANTAGEOUS EFFECTS

The medical objections are removed because no needles are required either directly or indirectly and an axially outer tube, preferably plastic tube, large enough to permit inflation direct from a pump is combined with an axially inner tube, preferably plastic tube, small enough to ensure that the gas is sealed in the balloon when the axially inner tube is withdrawn. Further, the invention enables the effective life of a shuttlecock to be extended at very small cost because the skirt and cap which are not affected by the said interval, are reused.

MODE OF CARRYING OUT THE INVENTION

FIG. 1 is a much enlarged diagrammatic partial view of an inventive balloon assembly incorporating a balloon inlet, a compressing device and an inflating tube.

FIG. 2 shows on the same enlarged scale, the compressing device.

FIG. 3 shows on the same enlarged scale, the inflating tube.

FIG. 4 shows the siting of the inflatable balloon when in use in a shuttlecock.

FIG. 5 shows the basic assembly.

FIG. 6 shows the same assembly as further developed.

Referring to FIG. 1, 2 and 3 there is shown the inlet 1 of a balloon, a compressing device 2 such as a strong elastic ring for example, a suitable 'O'-ring and a small bore tube 3, 4 incorporating two preferably integral parts 3 and 4 having substantially different external diameters namely, a larger external diameter axially outer part 3 and, adjoining the larger external diameter part 3, a substantially smaller external diameter axially inner part 4. The compressing device 2 has a small central hole 5 and the balloon inlet 1 is forcibly drawn through that small hole 5 which causes a compressed area indicated in FIG. 1 by arrows 11.

The free end of the substantially smaller external diameter part 4 of said tube 3, 4 is forcibly drawn through the inside of the balloon inlet 1 within the compressed area 11 and into the inflatable portion 8 of the balloon. The larger external diameter part 3 of said tube 3, 4 remains outside the compressed area 11 and may be connected to a pump. By way of indication but not limitation, the larger external diameter part 3 is about 0,8 mm diameter and the smaller external diameter part 4 is about 0,35 mm diameter.

Referring again to FIG. 3, an inflating tube made, for instance, from a polyester elastomer about 70 mm long and 0.8 mm diameter can be used to make two of the desired small bore tubes 3, 4. A pair of clamps 12 (one pair shown) are fitted 33 mm from each end of the said 70 mm long tube so that there is a 4 mm gap between the said clamps 12. The clamps are then moved smoothly apart in a controlled manner, preferably by hydraulic means. This action makes the tube in the gap substantially longer and smaller so that it reduces to diameter 0.35 mm. The resulting tube is then cut in two.

Referring to FIG. 4, when being used in a shuttlecock which has an inner skirt with a skirt connection 6 incorporating a diaphragm 7, the inflatable balloon is sited so that the inflatable portion 8 of the balloon (shown inflated in FIG. 4 for clarity) is partially within the inner skirt of the shuttlecock. The inlet 1 and compressing device 2 are retained at the diaphragm 7 of the skirt connection 6. As shown more clearly in FIG. 5, the smaller external diameter end part 4 of the small bore tube 3, 4 is held in the part of the balloon inlet 1 which is compressed by the device 2 with its extreme end slightly in the inflatable portion 8 of the balloon. The larger diameter part 3 of the small bore tube passes through a hole 10 in the cap 9 of the shuttlecock so that it can be inserted in a pump connection. A sealing lubricant may be used to assist withdrawal.

Referring to FIG. 6, a small part of the closed end 15 of the inflatable portion 8 of the balloon is shown drawn into a large bore tube 14. When required for use, the open end of the large bore tube 14 is then fed through the hole 10 in the cap 9 of the shuttlecock and an orifice in the diaphragm 7 of the skirt connection 6 and the inflatable part of the replacement balloon is pulled into the part surrounded by the inner skirt of the shuttlecock. The balloon may then be inflated through the larger end of the small bore tube 3. The large bore tube 14 can be pulled off or it may fly off during inflation. As an indication but not a limitation the external diameter of the large bore tube 14 may be 3.2 mm and the internal diameter may be 3 mm.

What is claimed is:

1. An inflatable balloon assembly for use in combination with a shuttlecock which has an inner skirt, the assembly comprising:

a balloon which incorporates a balloon inlet (1) and an inflatable portion (8), the inflatable portion (8) having a closed end (15) opposite said balloon inlet (1), an inflating device which incorporates a flexible inflating tube (3, 4), and a compressing device which has a small hole (5) through which the said balloon inlet (1) extends thus forming a compressed area (11) in said balloon inlet (1), characterized in that said flexible inflating tube (3, 4) incorporates two parts having substantially different external diameters namely, a larger external diameter part (3) which remains outside the said compressed area (11) and which is adapted to be connected to a pump and, adjoining the said larger external diameter part (3), a substantially smaller external diameter part (4) the free end of which extends through the inside of said balloon inlet (1) within said compressed area (11) thereof into the inflatable portion (8) of said balloon, and the inflatable balloon assembly further comprises a large bore tube (14), a part of said closed end (15) of said balloon extending into one end of the said large bore tube (14), the arrangement being such that the inflatable portion (8) of the balloon may be drawn, by means of said large bore tube (14) into a space within said shuttlecock which is surrounded by the said inner skirt thereof, the inflatable portion (8) being adapted to be subsequently inflated within said space.

2. The inflatable balloon assembly as in claim 1 wherein the said inflating tube (3, 4) is a plastic tube.

3. The inflatable balloon assembly as in claim 1 or claim 2 wherein the said smaller external diameter part (4) of said inflating tube (3, 4) is integral with said larger external diameter part (3) thereof.

4. The inflatable balloon assembly as in claim 1 wherein the larger external diameter part (3) of said inflating tube (3, 4) has an external diameter of 0.7 mm to 0.9 mm whereas the smaller external diameter part (4) has an external diameter of 0.3 mm to 0.4 mm.

5. The inflatable balloon assembly as in claim 1 wherein said compressing device (2) comprises at least one 'O'-ring.

6. The inflatable balloon assembly as in claim 1 wherein said large bore tube has an internal diameter of approximately 3.0 mm and an external diameter of approximately 3.2 mm.

* * * * *